United States Patent [19]

Hentschel et al.

[11] 4,308,075

[45] Dec. 29, 1981

[54] CONTINUOUSLY OPERABLE SUGAR CENTRIFUGAL

[75] Inventors: Volkmar Hentschel, Brunswick; Heinrich Kurland, Lucklum; Helmut Schaper, Brunswick; Joachim Schueller, Walle; Gustav Warner; Erwin Zeichner, both of Brunswick, all of Fed. Rep. of Germany

[73] Assignee: Braunschweigische Maschinenbauanstalt, Brunswick, Fed. Rep. of Germany

[21] Appl. No.: 196,066

[22] Filed: Oct. 10, 1980

[30] Foreign Application Priority Data

Oct. 16, 1979 [DE] Fed. Rep. of Germany ... 7929249[U]

[51] Int. Cl.³ ..... C13F 1/06

[52] U.S. Cl. ..... 127/19; 210/380.1; 233/2; 233/46

[58] Field of Search ..... 127/19; 233/2, 46, 47; 210/380.1

[56] References Cited

U.S. PATENT DOCUMENTS 3,805,956 4/1974 Mercier ..... 127/19 X

FOREIGN PATENT DOCUMENTS 1158449 11/1963 Fed. Rep. of Germany ... 210/180.1
2324373 10/1974 Fed. Rep. of Germany ..... 233/2
2749285 5/1979 Fed. Rep. of Germany ..... 127/19

*Primary Examiner*—Michael S. Marcus
*Attorney, Agent, or Firm*—W. G. Fasse; D. H. Kane, Jr.; D. F. Gould

[57] ABSTRACT

A continuously operable sugar centrifuge separates sugar massecuites into syrup portions of differing quality and crystalline sugar. The centrifugal screening basket is mounted for rotation within a housing divided into a plurality of different compartments for receiving syrup portions of differing quality from the screening basket. The housing also includes a first common collecting chamber for green syrup and a second common collecting chamber for high green syrup. Adjustable valves are provided between at least some of the compartments and the collecting chambers for alternatively connecting a compartment to either the first or second collecting chamber for separate discharge of syrup according to the quality of syrup received in the compartment. Mixing of syrup portions of differing quality is prevented by sealing elements even though the transition zone from green syrup to high green syrup shifts up or down along the basket wall.

7 Claims, 3 Drawing Figures

CONTINUOUSLY OPERABLE SUGAR CENTRIFUGAL

CROSS REFERENCE TO RELATED APPLICATION

The present application is based on the corresponding German Utility Model G 7,929,249.2 filed in the Federal Republic of Germany on Oct. 16, 1979. The priority of said German filing date is hereby expressly claimed.

BACKGROUND OF THE INVENTION

This invention relates to continuously operable sugar centrifugals with separate discharge and collection of green syrup and high green syrup. In particular, it is concerned with centrifuges in which a motor operated generally conical upwardly flared basket rotating around a vertical axis is provided on the inside with a separating screen and a supporting screen. The basket is arranged within a housing divided into individual compartments for separate reception of syrups of different qualities. To the extent possible the sugar industry endeavors to avoid purification steps for syrups derived from sugar processing. For this reason the green and high green syrups from batch-type centrifugals, for example, are discharged separately.

Numerous attempts have been made to perform this separation in continuously operating centrifugals, as well. But the varying compositions of the massecuites result in the fact that the transition zone on the basket from green syrup to high green syrup continually shifts in axial direction. In order to achieve a fairly reasonable separation, the centrifugals according to DE-PS No. 100,787 and also to FR-PS No. 1,255,703 are provided with a plurality of compartments for syrup collection.

These machines are very complicated and difficult to clean, and ultimately do not prevent mixing of the syrups in or on the basket.

OBJECTS OF THE INVENTION

In view of the foregoing it is the aim of the invention to achieve the following objects singly or in combination:

- to provide a simply designed continuously operable sugar centrifuge which permits separate discharge and collection of syrup portions of different grade or quality derived from the processing of sugar massecuites of varying composition;
- to prevent mixing on the basket wall of green syrup and high green syrup or other desired gradations of syrups centrifugally extracted from sugar massecuites;
- to maintain separate discharge of the different gradations of syrup even though the transition zone between the green syrup and high green syrup or other gradations of syrup quality shifts in the axial direction along the basket wall; and
- to prevent remoistening and contaminations of sugar crystals passing along the zones of the centrifugal screening basket by the separated syrup portions.

SUMMARY OF THE INVENTION

In order to accomplish these results, the present invention provides a centrifugal screening basket mounted for rotation within a housing divided into a plurality of separate compartments for receiving the syrup portions of differing grade or quality from the massecuites in the screening basket. Adjustable valves are provided between at least some of the compartments and first and second common collecting chambers for green syrup and high green syrup respectively. The compartments are alternatively connected to either the first or second collecting chambers according to the varying composition of massecuites in the basket and the quality of syrup received in the compartments. Separate discharge and separation of syrup grades is thereby maintained despite axial shifts in the transition point between green syrup and high green syrup.

The invention also provides annular seals of "L" shaped cross-section around the basket shell to prevent the syrup on the basket shell from flowing from the green syrup zone into the high green syrup zone. The transition point from green to high green syrup may therefore move on the basket at random. For syrup separation it is only necessary to connect a respective compartment, for example, in the green zone to the common collecting chamber for green syrup by actuating the slide valve. When the change point moves down, the respective compartment is connected again to the common collecting chamber for high green syrup.

Accumulations of syrup before the annular seals may cause sugar to be remoistened with green syrup through the separating screen, at least where large amounts of syrup are concerned. This is eliminated by the invention. The long sides of the "L" shaped seals are positioned between the basket shell and the rear side of the separating screen to form tight syrup intercepting chambers open towards the narrow basket end. The syrup can escape through the associated discharge openings only.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
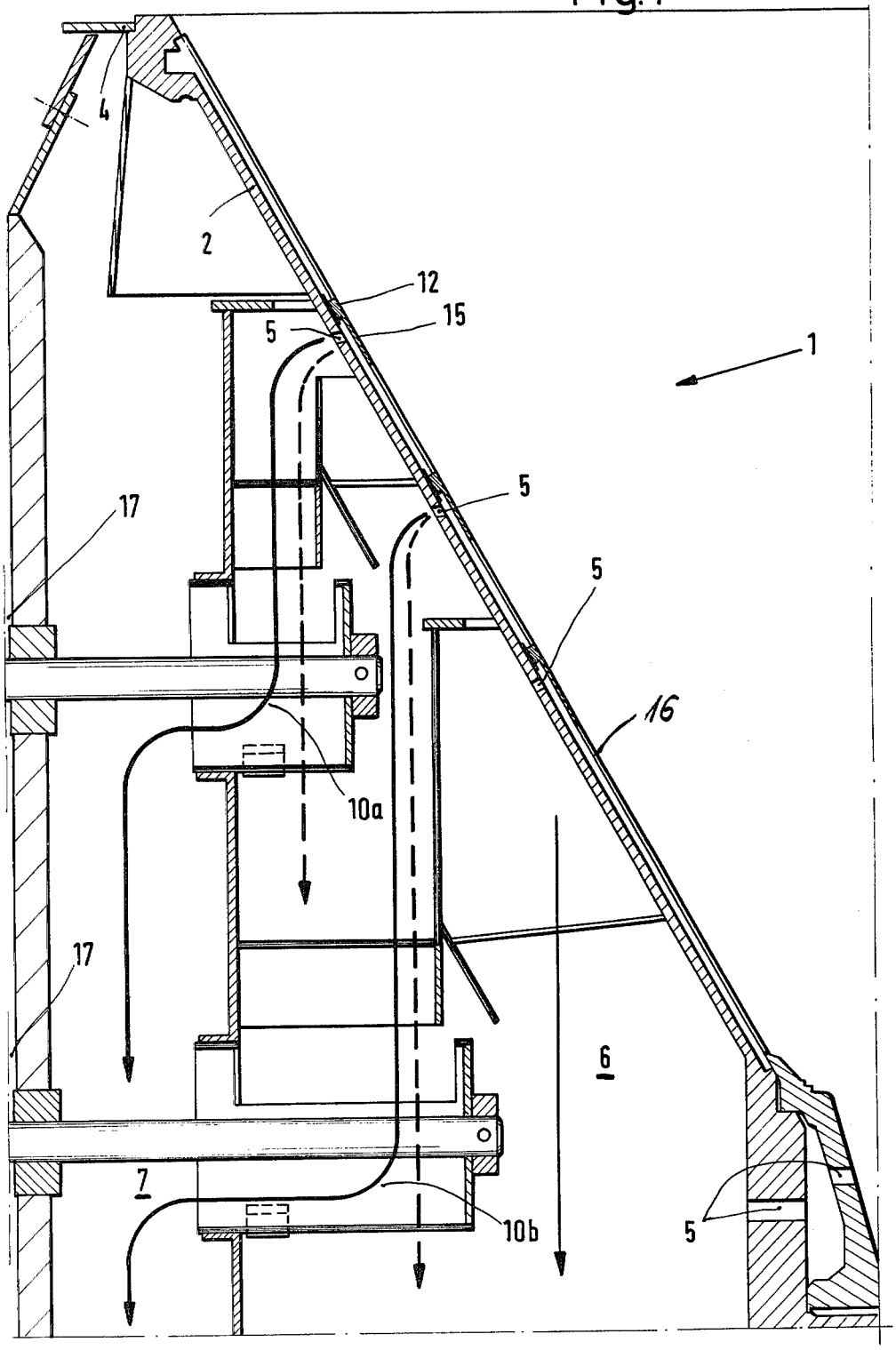
FIG. 1 is a schematic sectional view through the side of a centrifuge according to the invention.

FIG. 1 reflects the nature of the invention, i.e., the common inventive idea encompassing the possible variants.

In the continuously operable sugar centrifugal 1 (shown in part only) an upwardly flared frustum-shaped centrifugal basket 2 rotating around a vertical axis at the right of FIG. 1 is provided with a separating screen (not shown) and separates sugar massecuites into sugar and syrup. While the crystalline sugar, retained by the separating screen, moves toward the upper end of the centrifugal basket 2 and leaves same over the edge 4, the syrup passes through the separating screen and the supporting screen 16 and leaves the centrifugal basket 2 through the respective discharge openings 5.

At its outside the centrifugal basket is surrounded by at least two liquid collecting chambers 6 and 7. Collecting chamber 6 serves for receiving the green syrup and collecting chamber 7 for receiving the high green syrup or white syrup as it is sometimes called.

Figure 2:
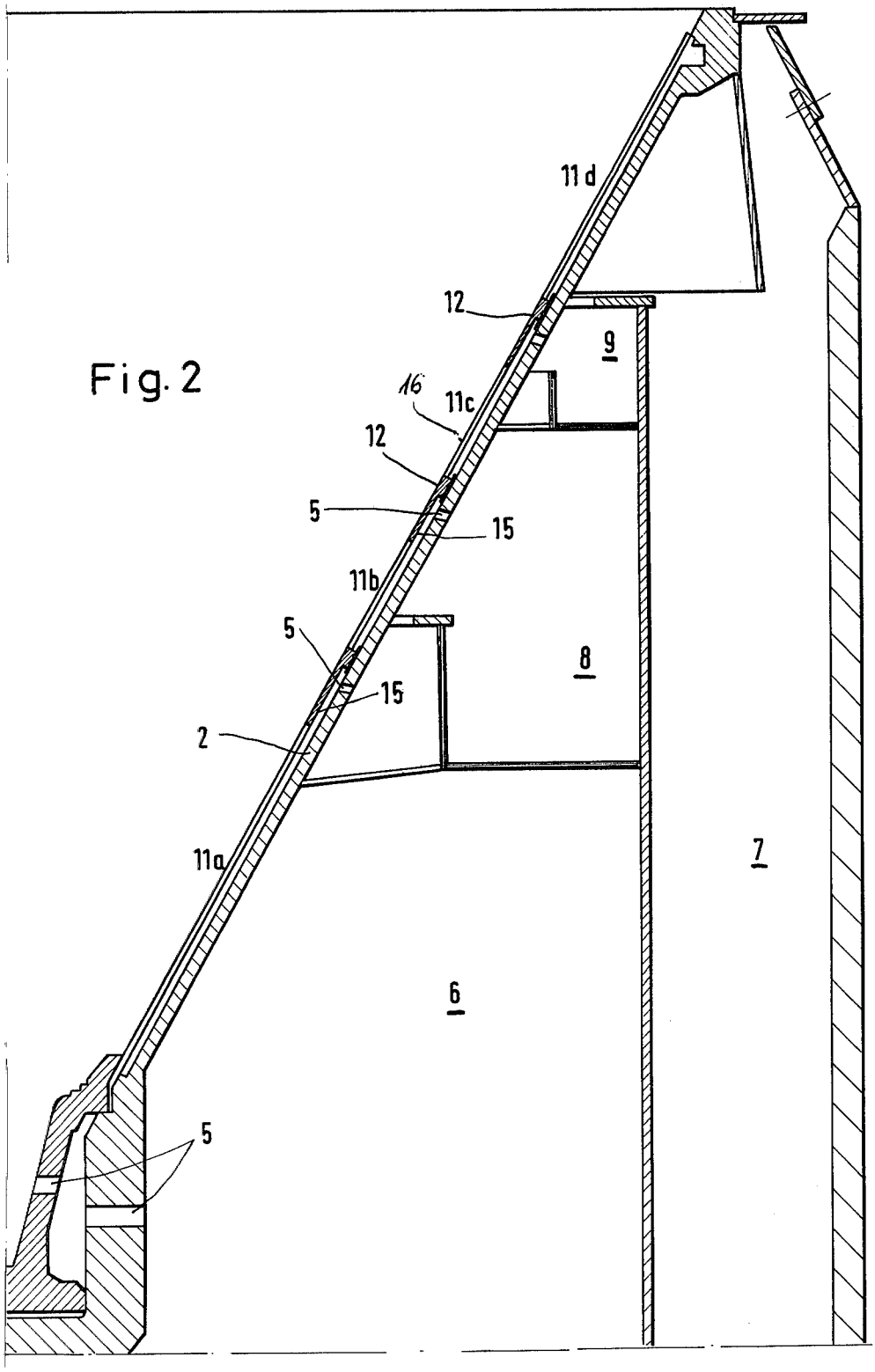
FIG. 2 is a schematic sectional view of the centrifuge showing the arrangement of the individual compartments and the collecting chambers.

The collecting chamber 6 for green syrup as per FIG. 2 is divided into at least two shell-shaped or trough-shaped individual compartments 8 and 9. Subject to the purity of the syrup, the compartments 8 and 9 are connected by way of the slide valves 10*a* and 10*b* with the collecting chamber 6 for green syrup or the collecting chamber 7 for high green syrup. The vertical axis of rotation is at the left of FIG. 2.

When the syrup has a high purity the two compartments 8 and 9 shown in FIG. 2 are connected by way of the slide valves 10*a* and 10*b* to the collecting chamber 7 for high green syrup. When it has a low purity, however, it flows from compartments 8 and 9 through the slide valves 10*a* and 10*b* (after same have been changed over by the hand lever 17 or by adjusting elements not shown) into the collecting chamber 6 for green syrup. For syrup of medium purity the slide valves 10*a* and 10*b* are so adjusted that the syrup from compartment 9 flows into the collecting chamber 7 for high green syrup and that from compartment 8 into the collecting chamber 6 for green syrup.

The syrup enters the individual screen zones or sub-zones 11*a*, 11*b*, 11*c*, and 11*d* opposite the compartments 8 and 9 inside the basket 2 at different sugar purities. The screen zones 11*a*, 11*b*, 11*c* and 11*d* are sealed from one another by sealing elements 12/15 (enlarged in FIG. 3). The "L" shaped sealing elements define a syrup intercepting chamber adjacent the seal, opening downwardly. Any accumulation of syrup in the intercepting chambers and, as a result, the return of syrup through the separating screen 18 out into the sugar layer is rendered impossible by the depending side 15 of sealing elements 12/15. In addition, the sealing elements 12/15 prevent syrups containing different sugar percentages from passing from the respective lower zone (e.g. 13) into the next higher zone 14. The seal 12 is "L" shaped and by its longer thin side 15 pointing toward the small diameter or narrow end of the conical centrifugal basket 2 rests on the supporting screen 16.

Figure 3:
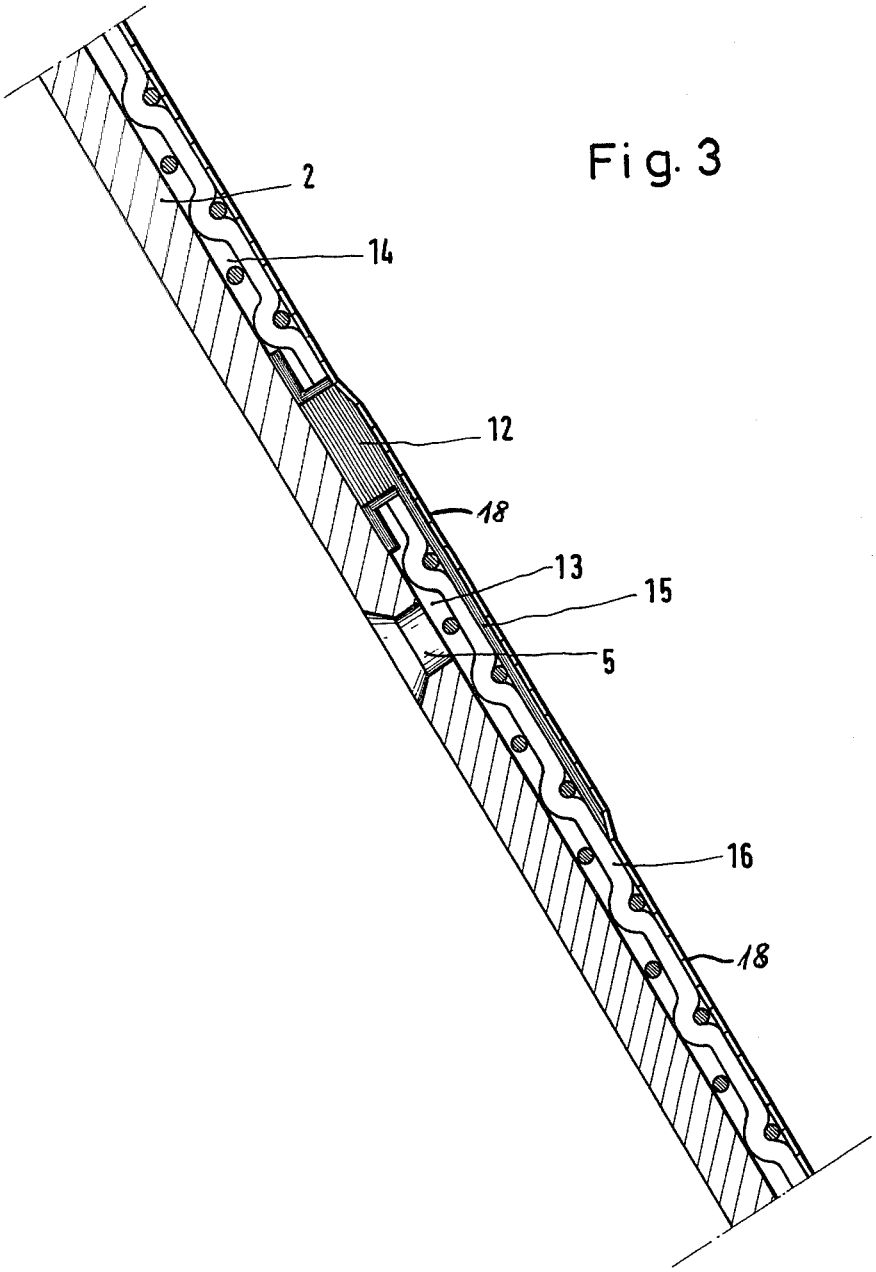
FIG. 3 is an enlarged sectional view of an annular "L" shaped seal and a portion of the basket wall.

FIGS. 1 and 2 show just two individual compartments 8 and 9 in a simplified manner, but their number can be increased according to the separation requirements. The number of slide valves 10*a* and 10*b* and the number of seals 12/15 shown in FIG. 3 are also increased at the same time according to the number of compartments. Although the invention has been described with reference to specific example embodiments, it is to be understood, that it is intended to cover all modifications and equivalents within the scope of the appended claims.

What is claimed is:

1. A continuously operable sugar centrifuge for separating sugar massecuites into crystalline sugar and into syrup portions of differing quality comprising: centrifugal basket means of upwardly flaring generally frusto-conical configuration comprising shell means and screening means; housing means, said centrifugal basket means being mounted for rotation about a vertical axis within said housing means, said housing means comprising a plurality of separate compartments for separately receiving syrup portions of differing quality through said basket means, and at least a first common collecting chamber for green syrup and a second common collecting chamber for high green syrup; adjustable valve means coupled between at least one of said compartments and said first and second common collecting chambers for alternatively connecting said compartment to either the first or second collecting chambers according to the quality of syrup received in the compartment; said shell means comprising a plurality of discharge openings associated with respective compartments; and a plurality of annular seal means arranged around the basket means dividing the basket means into a plurality of zones or sections associated with the respective compartments and discharge openings.

2. The centrifuge of claim 1, wherein the centrifugal basket means comprises an upper zone, lower zone, and intermediate zone, said lower zone formed with openings communicating with the first common collecting chamber for green syrup, said upper zone formed with openings communicating with the second common collecting chamber for high green syrup, said intermediate zone comprising sub-zones formed with openings communicating respectively with at least two compartments each with adjustable valve means for coupling the respective compartment alternatively to either the first or second collecting chamber.

3. The centrifuge of claim 2, wherein the boundaries between said zones and said sub-zones comprise annular seal means arranged around the centrifugal basket shell means separating the screening means into said zones and sub-zones thereby to prevent mixing of syrup portions in the respective zones and sub-zones.

4. The centrifuge of claim 1, wherein said screening means comprises at least a supporting screen and an adjacent separating screen wherein said plural annular seal means have essentially "L" shaped cross-section with the long side of the "L" arranged between the supporting screen and separating screen opening toward the narrow end of the centrifugal basket to form syrup intercepting chambers adjacent the seal means.

5. The centrifuge of claim 4, wherein the annular seal means is formed of a resilient material.

6. The centrifuge of claim 5, wherein the long side of the "L" shaped cross-section seal means is formed with a stiff reinforcing or supporting layer.

7. The centrifuge of claim 1, wherein said plural annular seal means have essentially "L" shaped cross-sections with the long side of the "L" arranged between the centrifugal basket shell means and screening means opening toward the narrow end of the basket means to form syrup intercepting chambers adjacent each seal means from which the syrup may escape through said associated discharge openings.

* * * * *